United States Patent [19]

Edwards

[11] Patent Number: 4,476,787

[45] Date of Patent: Oct. 16, 1984

[54] RAILWAY SWITCH

[76] Inventor: Lawrence K. Edwards, 3507 Slade Run Dr., Falls Church, Va. 22042

[21] Appl. No.: 371,283

[22] Filed: Apr. 23, 1982

[51] Int. Cl.[3] ..... B61J 1/06

[52] U.S. Cl. ..... 104/96; 104/130; 246/415 R

[58] Field of Search ..... 104/130, 130.1, 131, 104/132, 100, 96, 102, 103; 246/415 R, 435 R, 445, 430, 431, 448

[56] References Cited

U.S. PATENT DOCUMENTS

| | | | |
|---|---|---|---|
| 78,500 | 6/1868 | Wharton, Jr. | 246/445 |
| 1,411,162 | 3/1922 | Coates | 246/448 |
| 3,878,792 | 4/1975 | Larson | 104/96 |
| 3,890,904 | 6/1975 | Edwards | 104/121 |
| 4,174,820 | 11/1979 | Kempa | 104/130 |

*Primary Examiner*—Robert B. Reeves
*Assistant Examiner*—Glenn Foster
*Attorney, Agent, or Firm*—Senniger, Powers, Leavitt and Roedel

[57] ABSTRACT

A switch for a railway system having a common track, and upper and lower branch tracks, each track comprising a pair of rails with one rail disposed above the other. The switch comprises a fixed support between the common and branch tracks, upper and lower fixed switching rails on the fixed support associated with the upper and lower branch tracks, respectively, a pair of movable switching rails movable between a raised position in which the pair extends between the common track and the upper fixed switching rails and a lowered position in which the pair extends between the common track and the lower fixed switching rails, and a plurality of movable supports for the movable switching rails mounted on the fixed support at spaced intervals. Each movable support is guided for movement transversely with respect to the direction of length of the movable switching rails and generally in the plane of these rails. An actuator bar having linear cams thereon is engageable with the movable supports for moving each of them through a predetermined range of movement, the range of movement progressively increasing from the movable support adjacent the common track to the movable support adjacent the branch tracks.

8 Claims, 24 Drawing Figures

RAILWAY SWITCH

BACKGROUND OF THE INVENTION

This invention relates to a railway system and more particularly to a switch for a railway switching system.

This invention is generally in the same field as and may be regarded as representing an improvement upon the railway switch disclosed in my U.S. Pat. No. 3,890,904.

SUMMARY OF THE INVENTION

Among the several objects of this invention may be noted the provision of an improved railway switch providing increased operational reliability; the provision of such a railway switch which has a single actuating mechanism for moving the movable components of the switch; the provision of such a railway switch which has back-up systems for operating the actuating mechanism; the provision of such a railway switch which is operable with accumulations of ice and snow thereon; and the provision of such a switch which is of economical, module construction and may be rapidly erected as part of a railway system.

In general, this invention involves a railway switch for a railway system having a common track, a first branch track constituting an upper branch track, and a second branch track constituting a lower branch track, each track comprising a pair of rails with one rail of the pair disposed above the other. The switch comprises a fixed support means disposed between the common and branch tracks, a first pair of fixed switching rails constituting an upper pair of fixed switching rails on the fixed support means associated with the upper branch track, a second pair of fixed switching rails, constituting a lower pair of fixed switching rails, on said fixed support means associated with the lower branch track, and a pair of movable switching rails movable between a raised position in which the pair extends between the common track and the upper pair of fixed switching rails, and a lowered position in which it extends between the common track and the lower pair of fixed switching rails. The switch further comprises a plurality of movable supports carrying the movable switching rails mounted on the fixed support means at spaced intervals therealong, each movable support being guided for movement transversely with respect to the direction of length of the movable switching rails and generally in the plane of these rails. Means engageable with the movable supports moves each support through a predetermined range of movement with respect to the fixed support means transversely with respect to the direction of length of the movable switching rails and generally in the plane of these rails, the range of movement of the movable supports progressively increasing from the movable support adjacent the common track to the movable support adjacent the branch tracks.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
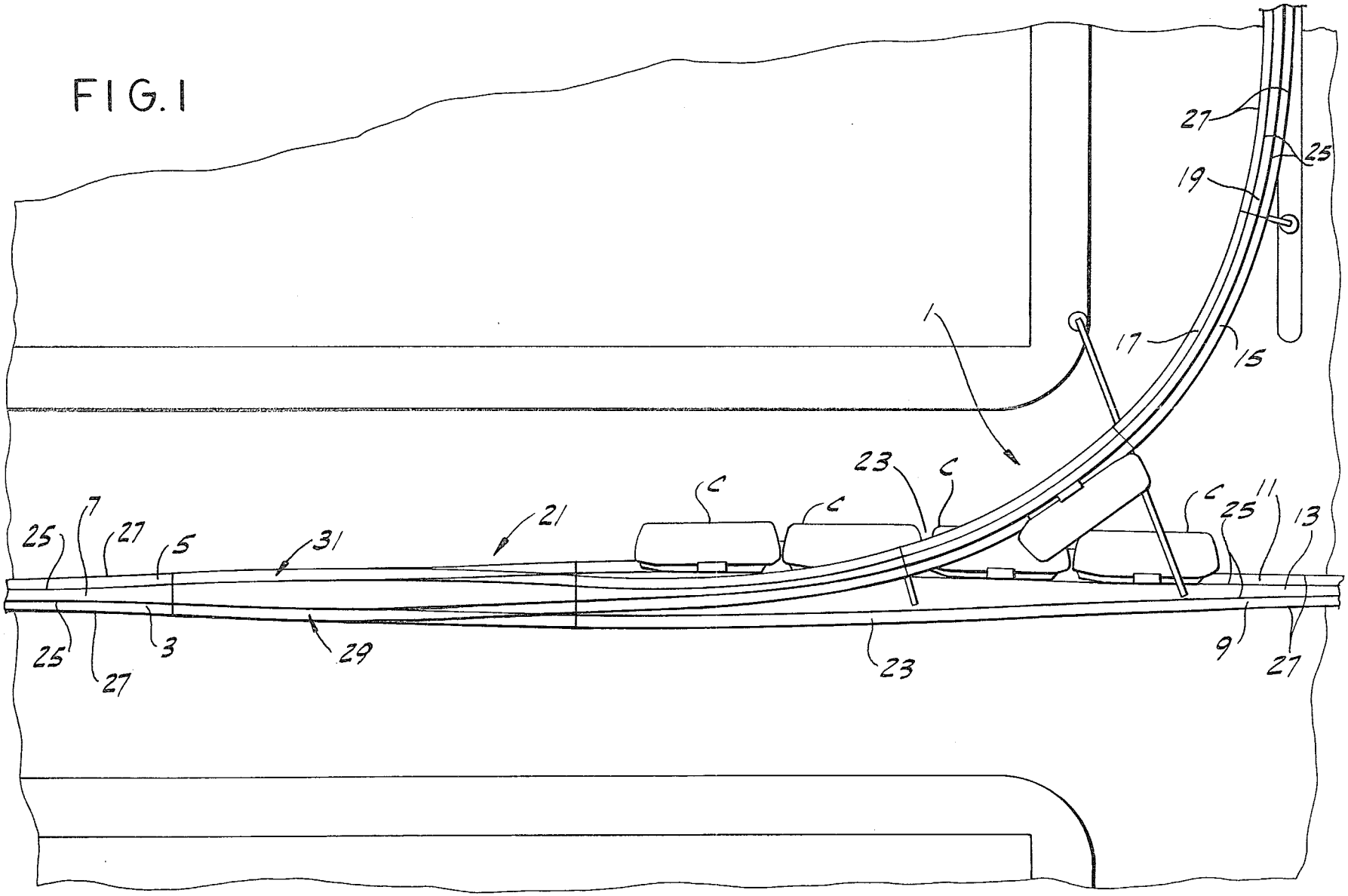
FIG. 1 is a top plan of a railway switching system including a switch assembly disposed between pairs of common and branch tracks, the switch assembly having a switch of this invention at each side thereof.

Referring to FIG. 1, there is generally indicated at 1 a railway switching system comprising a pair of common tracks 3, 5 on opposite sides of a first beam 7 which, as viewed in section, is generally triangular, a first (or lower) pair of branch tracks 9, 11 on opposite sides of a second generally triangular-section beam 13, a second (or upper) pair of branch tracks 15, 17 on opposite sides of a third generally triangular-section beam 19, and a switching assembly generally indicated at 21 between the common and branch tracks. A transition section 23 connects each pair of branch tracks to the switching assembly and supports the second pair of branch tracks above the first so that railway cars C on the first (lower) pair of branch tracks may pass beneath the second (upper) pair as shown in FIG. 1. Each track comprises upper and lower rails 25, 27, respectively, extending along a respective beam, the lower rails being disposed laterally outwardly of the upper rails with the railheads of the rails thus lying in an inclined plane (see FIGS. 1–3).

As illustrated in FIGS. 2–11, the switching assembly 21 comprises a fixed support means in the form of a truss 28 which is generally triangular in transverse section and of progressively increasing height and width from its end adjacent the common tracks (i.e., its left end as viewed in the figures) to its end adjacent the branch tracks (i.e., its right end). A pair of switches of this invention, generally indicated at 29, 31, on the inclined sides of the truss effect connection of the respective common and branch tracks. The switches 29, 31 are generally symmetrical to each other about the central vertical longitudinal plane of the switching assembly 21, so that a description of one switch will suffice for both.

As illustrated in FIGS. 2–5, the switch 29 comprises an upper pair of fixed switching rails 33 on the truss associated with the upper branch track 15, a lower pair of fixed switching rails 35 on the truss associated with the lower branch track 9, and a pair of movable switching rails 37 movable between a raised position in which the pair extends between the common track 3 and the upper pair of fixed switching rails 33 and a lowered position in which the pair extends between the common track 3 and the lower pair of fixed switching rails 35. The railheads of the fixed and movable rails 33, 35, 37 all lie in an inclined plane generally parallel to the side of the truss 28 on which they are mounted (see FIG. 8).

Figure 2:
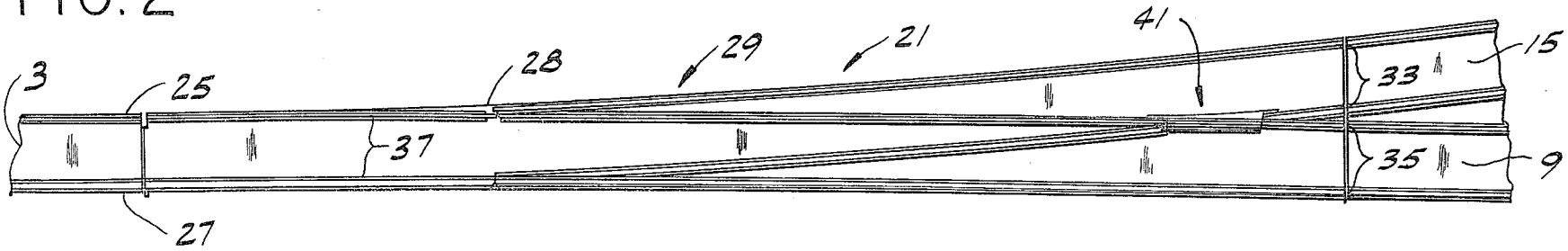
FIG. 2 is a side elevation of the switch assembly showing a switch.
Figure 3:
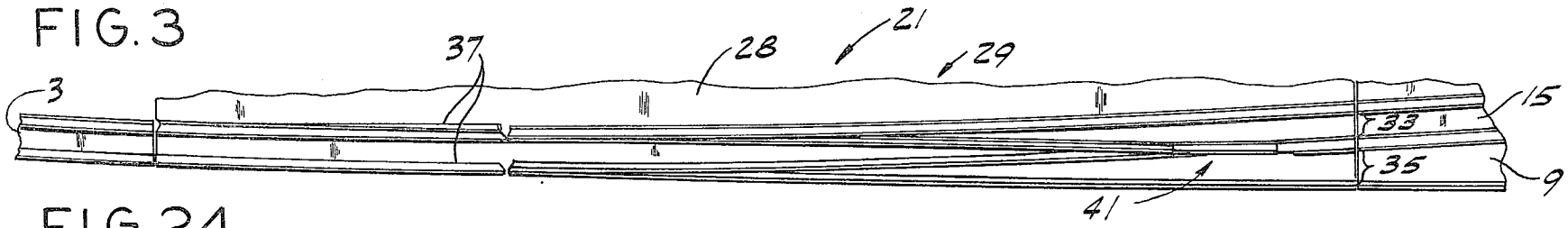
FIG. 3 is a fragmentary top plan of the switch assembly showing the switch of FIG. 2.

The switch 29 also includes rail crossover means, generally designated 41, mounted on the truss at the intersection of the lines defined by the upper rail of the lower fixed switching rails 35 and the lower rail of the upper fixed switching rails 33 for movement between a first position in which it is aligned with and forms a part of the upper rail of the lower fixed switching rails, as shown in FIG. 2, and a second position in which it forms a part of the lower rail of the upper fixed switching rails. As described more fully hereinafter, switching of the switch 29 between a first mode in which the switching rails 37 and the crossover means 41 are in position for connecting the common and lower branch tracks (3, 9 respectively) and a second mode in which they are in position for connnecting the common and upper branch tracks (3, 15, respectively) is accomplished by a single actuating mechanism.

Figure 5:
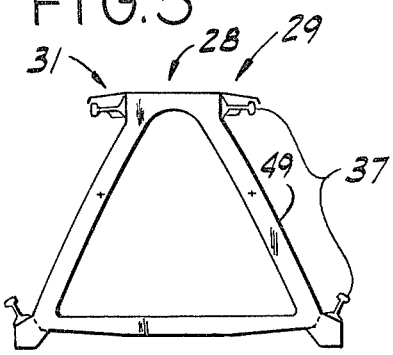
FIG. 5 is an end elevation on line 5—5 of FIG. 4.
Figure 6:
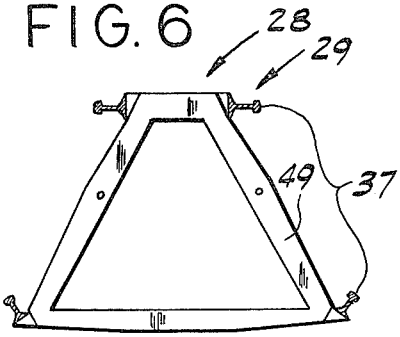
FIG. 6 is a section on line 6—6 of FIG. 4.
Figure 7:
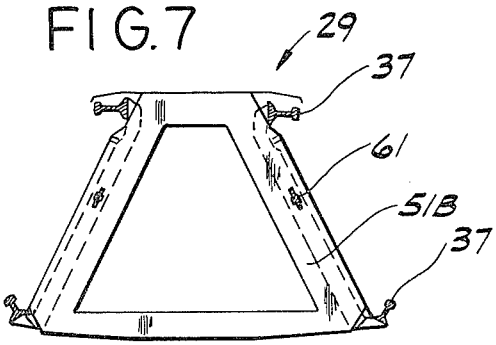
FIG. 7 is a section on line 7—7 of FIG. 4 showing pairs of movable switching rails on the switching assembly.
Figure 8:
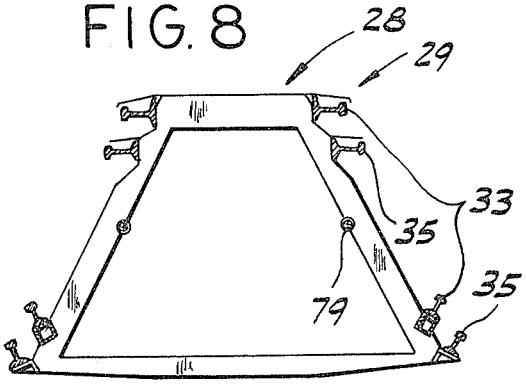
FIG. 8 is a section on line 8—8 of FIG. 4.
Figure 9:
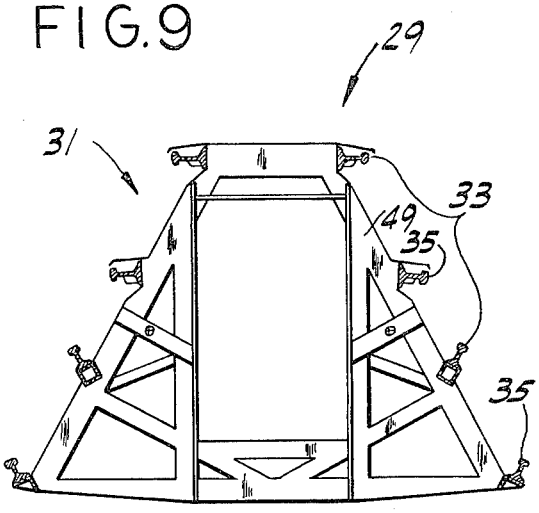
FIG. 9 is a section on line 9—9 of FIG. 4.
Figure 10:
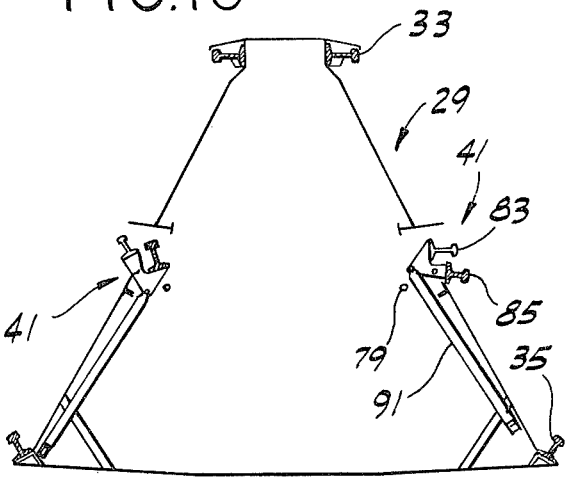
FIG. 10 is a section on line 10—10 of FIG. 4 showing crossover means at each side of the switching assembly.
Figure 11:
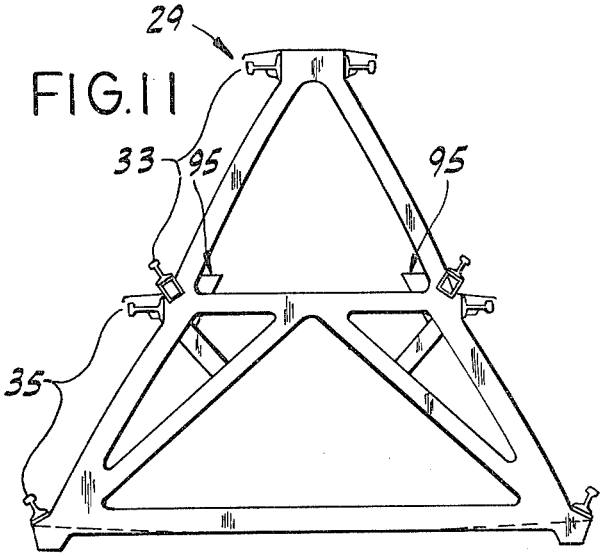
FIG. 11 is an end elevation on line 11—11 of FIG. 4.

Referring to FIGS. 4–11, the truss 28 comprises a plurality of generally triangular frame members 49 at spaced intervals along the truss (FIG. 5). Each frame member extends in a plane transverse to the longitudinal axis of the truss. The upper rails of the upper pairs of fixed switching rails 33 of the switching assembly are secured to the frame members adjacent the apices thereof and constitute upper chord members of the truss structure, and the lower rails of the lower pairs of fixed switching rails 35 are secured to the frame members at lower corners thereof and constitute lower chord members of the truss structure. Lengths of sheet material, such as sheet steel, are secured to the side and bottom edges of the frame members 49 and form the top, bottom and sides of the switching assembly. These lengths of sheet material have slots therein for accommodating movement of the movable switching rails 37 relative to the truss 28.

Figure 13:
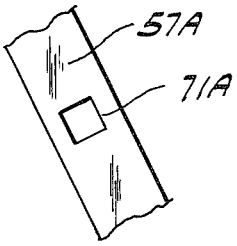
FIG. 13 is a fragmentary side elevation of the movable support of FIG. 12.
Figure 14:
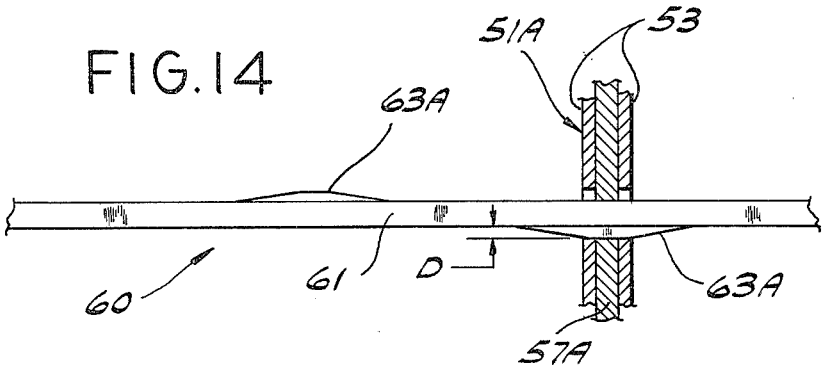
FIG. 14 is a view on line 14—14 of FIG. 12, with parts removed to show interior detail.

The movable switching rails 37 are mounted for movement between their stated raised and lowered positions by a plurality of rail supports (e.g., three supports) generally designated 51A, 51B and 51C at spaced intervals along the truss 28. Each support comprises a support member constituted by a tie bar 57A–57C, respectively, of rectangular-section bar stock extending transversely with respect to the rails and connected at its ends thereto, and a pair of elongate guide plates 53 extending alongside the tie bar on opposite sides thereof and secured at their ends to the truss (see FIGS. 12–14). The tie bar is slidable between the guide plates for moving the rails 37 up and down in the inclined plane of the rails. It will be noted in this latter regard that since the movement of the pair of switching rails 37 between its raised and lowered positions is generally a pivotal movement of the pair about its left end (its end adjacent the common track 3), the range of movement of the tie bars 57A–57C must progressively increase from the support 51A closest the common track to the support 51C closest the branch tracks 9, 15. A leaf spring 55 adjacent the upper ends of the guide plates 53 is engageable with the inner edge 59 of the tie bar.

Figure 18:
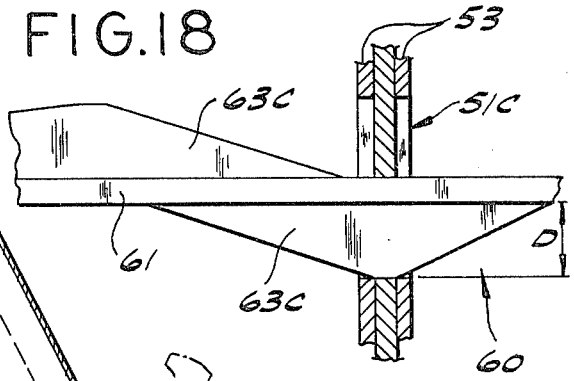
FIG. 18 is a view on line 18—18 of FIG. 17, with parts removed to show interior detail.

Means for moving the tie bars 57A–57C between respective guide plates 53 is indicated generally at 60. It comprises an elongate square-section actuator bar 61 mounted on the truss 28 for reciprocation longitudinally thereof, and pairs of linear cams 63A–63C, one pair for each tie bar 57A–57C, on the actuator bar 61 at spaced intervals therealong corresponding to the spacing between the tie bars (see FIGS. 4 and 14). The two cams of each pair of cams project laterally outwardly from the actuator bar on opposite sides of the bar (the top and bottom sides of the bar as viewed in the drawings) and lie in a plane generally parallel to the plane of the movable switching rails 37. As will appear, the outer camming surface or edge of one cam of each pair is engageable with a respective movable support on movement of the actuator bar 61 in one direction for moving the support to one extreme of its range of movement, and the outer camming surface or edge of the other cam of the pair is engageable with the support on movement of the bar in the opposite direction for moving the support to the opposite extreme in its range of movement. The shape of the cams of each pair is generally similar to the shape of the cams of the other pairs, but their size differs. In this regard, the maximum distance D which the camming surface of each of the two cams of a pair of cams projects from the actuator bar progressively increases from the pair of cams 63A adjacent the common track to the pair 63C adjacent the branch tracks (compare FIGS. 14 and 18). The cams of each pair of cams are offset with respect to one another longitudinally of the bar, with the longitudinal distance between the apices of the camming surfaces of each pair of cams being the same as that for the other pairs.

Figure 12:
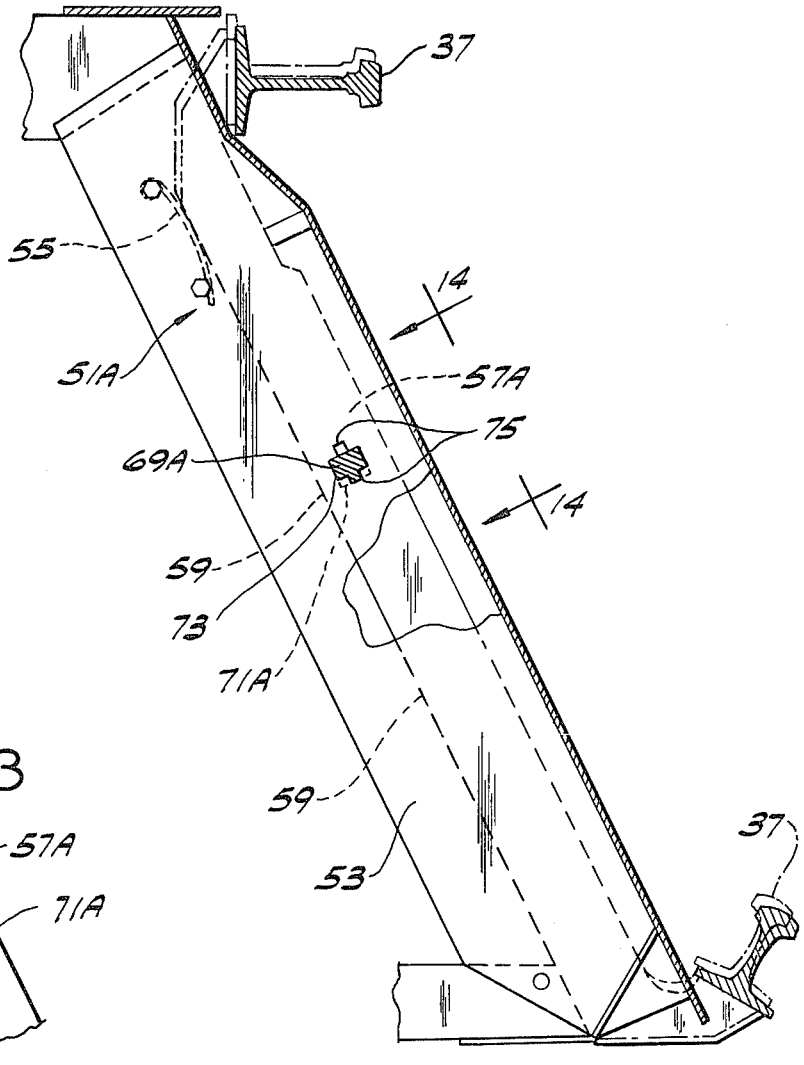
FIG. 12 is an enlarged section on line 12—12 of FIG. 4 showing a movable support of the switch of FIG. 2 carried on fixed supporting means.
Figure 15:
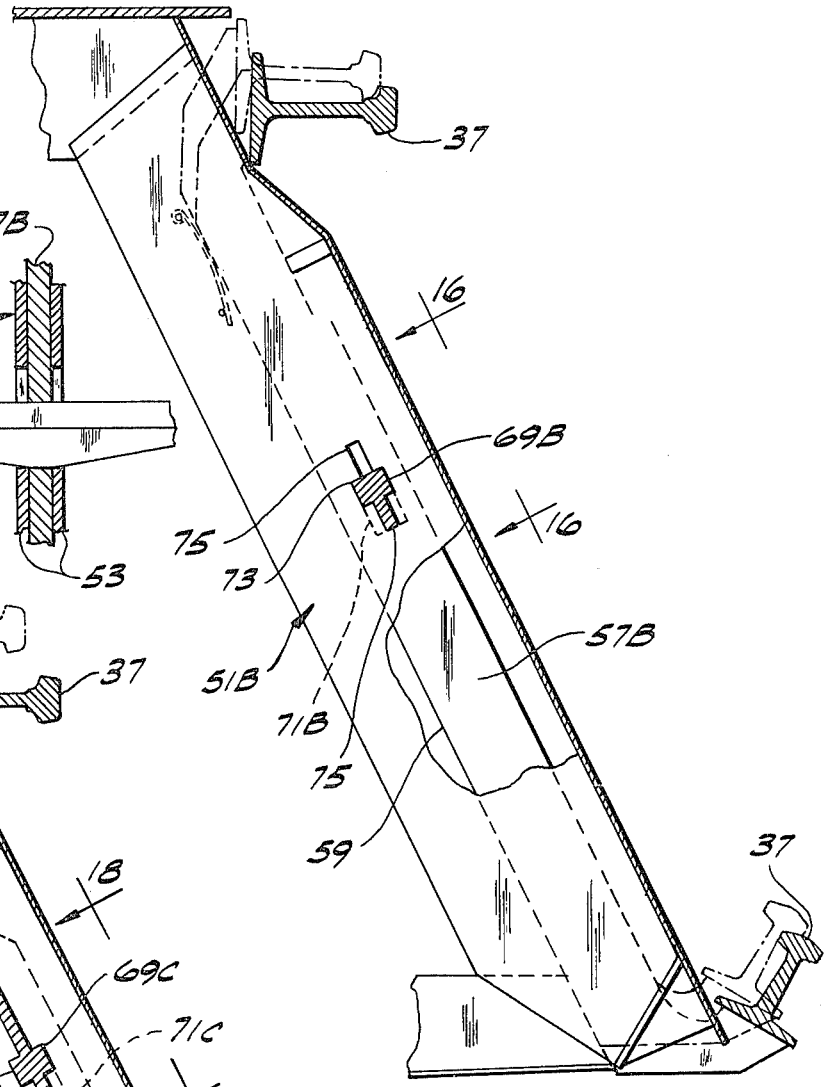
FIG. 15 is an enlarged view similar to FIG. 7.
Figure 16:
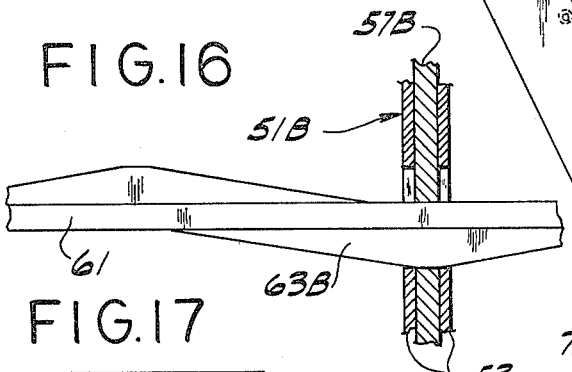
FIG. 16 is a view on line 16—16 of FIG. 15, with parts removed to show interior detail.
Figure 17:
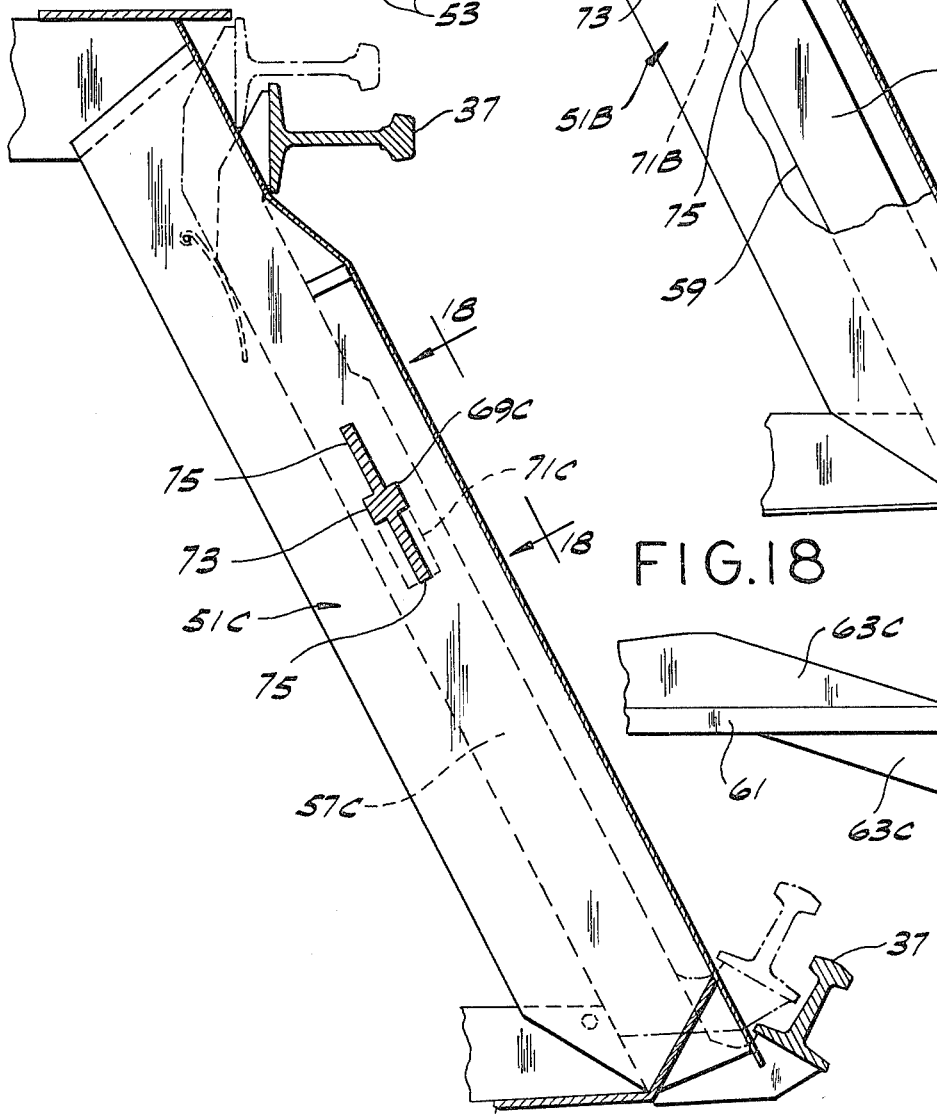
FIG. 17 is an enlarged section on line 17—17 of FIG. 4.

The actuator bar 61 extends through holes 69A–69C in the guide plates 53 and through holes 71A–71C in the tie bars 57A–57C. As shown in FIGS. 12, 15 and 17, each of the holes 69A–69C in the guide plates has a generally square portion 73 for receiving the actuator bar, and upper and lower slot portions 75 extending from the square portions along a line parallel to the plane of the movable switching rails 37 for receiving the cams. The square portion 73 of each hole is sized for a close fit of the actuator bar 61 therein, while the slot portions 75 are sized to be considerably longer than the aforementioned maximum distances D which the cams project from the bar. In contrast, each of the holes 71A–71C in the tie bars 57A–57C is generally rectangular and has a height corresponding to the height of the actuator bar 61 plus the maximum distance D which one cam of a respective pair of cams projects from the bar. The upper and lower surfaces of these holes are thus engageable by the upper and lower edges of the cams upon reciprocation of the actuator bar. As shown in FIGS. 4, 14, 16 and 18, with the actuator bar 61 in a position in which the camming surfaces of the lower cams engage the bottoms of the holes 71A–71C in the tie bars 57A–57C, the movable switching rails 37 are supported in their lowered positions. Upon moving the actuator bar 61 toward the branch tracks (toward the right as viewed in FIGS. 4, 14, 16 and 18), the camming surfaces of the upper cams engage the top of the respective holes 71A–71C in the tie bars for moving the movable switching rails to their raised positions.

The actuator bar is reciprocated in the direction of its length to raise and lower the switching rails 37 by a pair of suitable linear actuator means, such as hydraulic or pneumatic cylinder units 77, 78, mounted on the truss 28 at the ends of the bar (see FIG. 4), the length of the stroke of the piston rod of each unit corresponding to the distance between adjacent pairs of cams 63. The piston rod of the left end cylinder unit 77 is detachably secured to the left end of the actuator bar by suitable means such as a pin and clevis arrangement (not shown). The piston rod of the right end cylinder unit 78 is detachably secured to the other (right) end of the actuator bar via an operating rod 79. Each cylinder unit is controlled by an independent hydraulic or pneumatic control circuit and is capable of providing sufficient force to reciprocate the actuator bar and raise the pair of movable tracks under normal conditions without the assistance of the other cylinder unit. This enables operation of the switch 29 when an accumulation of ice or snow on the actuator bar 61 increases the resistance to movement of the bar, or when one of the units fails to operate, thereby increasing the operational reliability of the switch.

Figure 19:
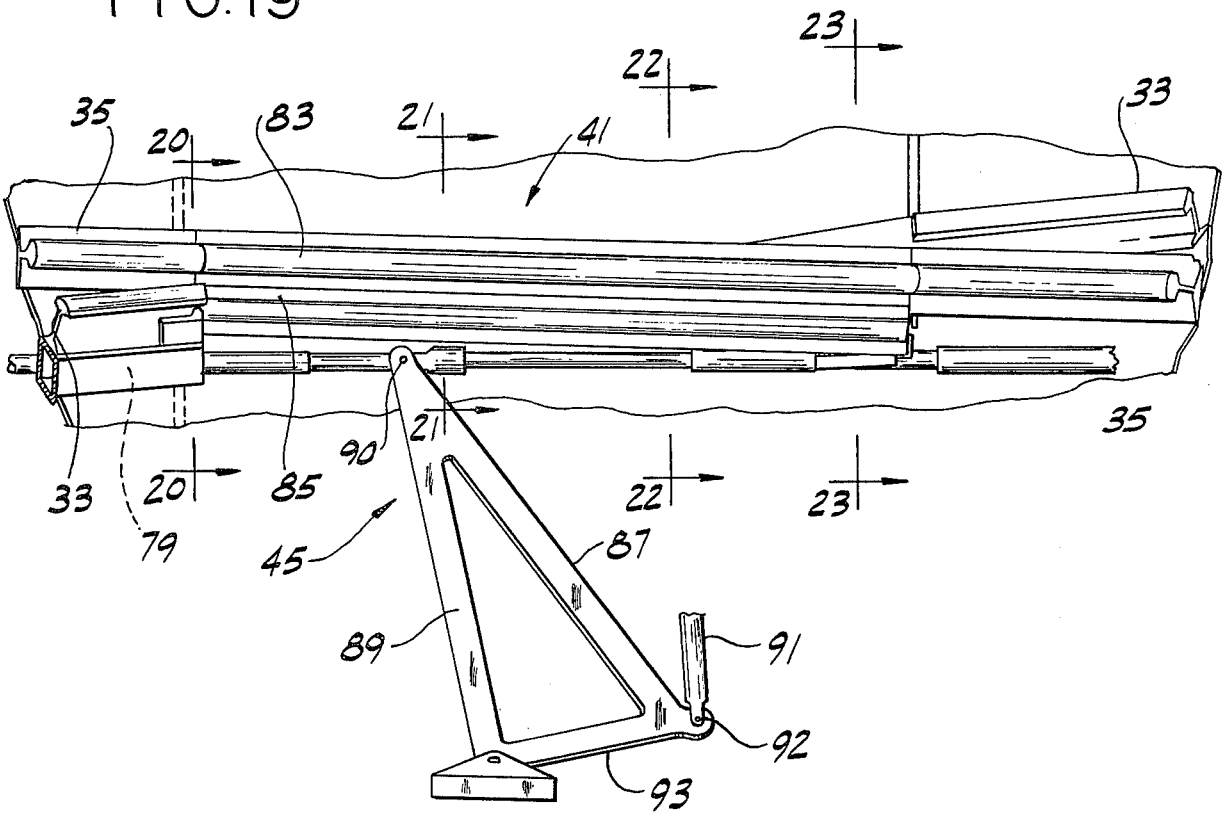
FIG. 19 is an enlarged elevation of the crossover means of the switch.
Figure 21:
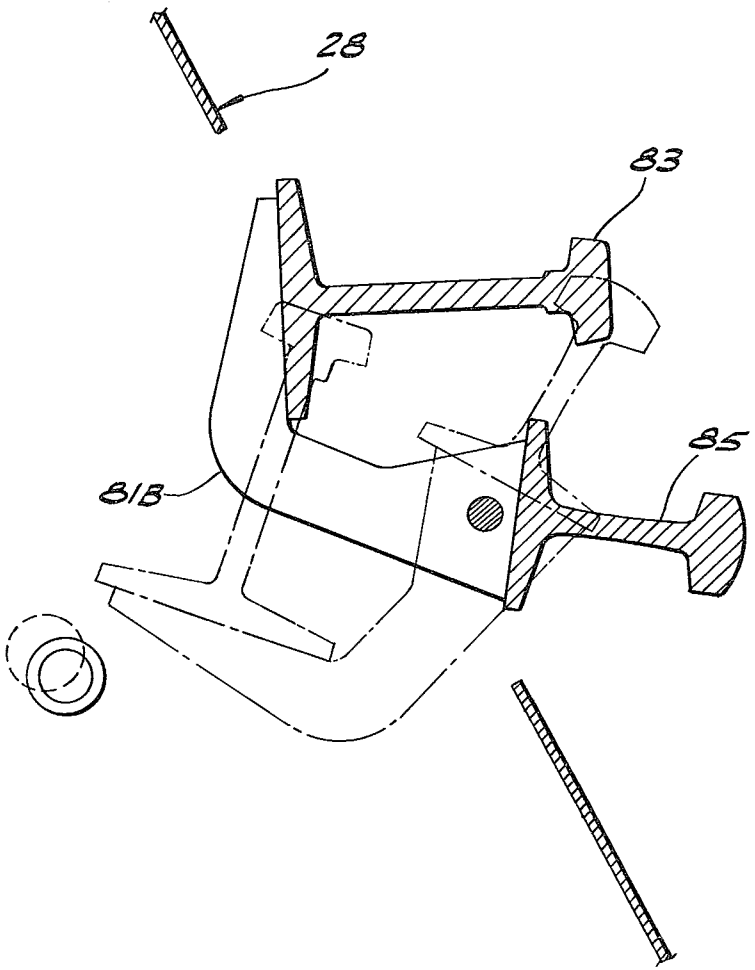
FIG. 21 is an enlarged section on line 21—21 of FIG. 19.
Figure 20:
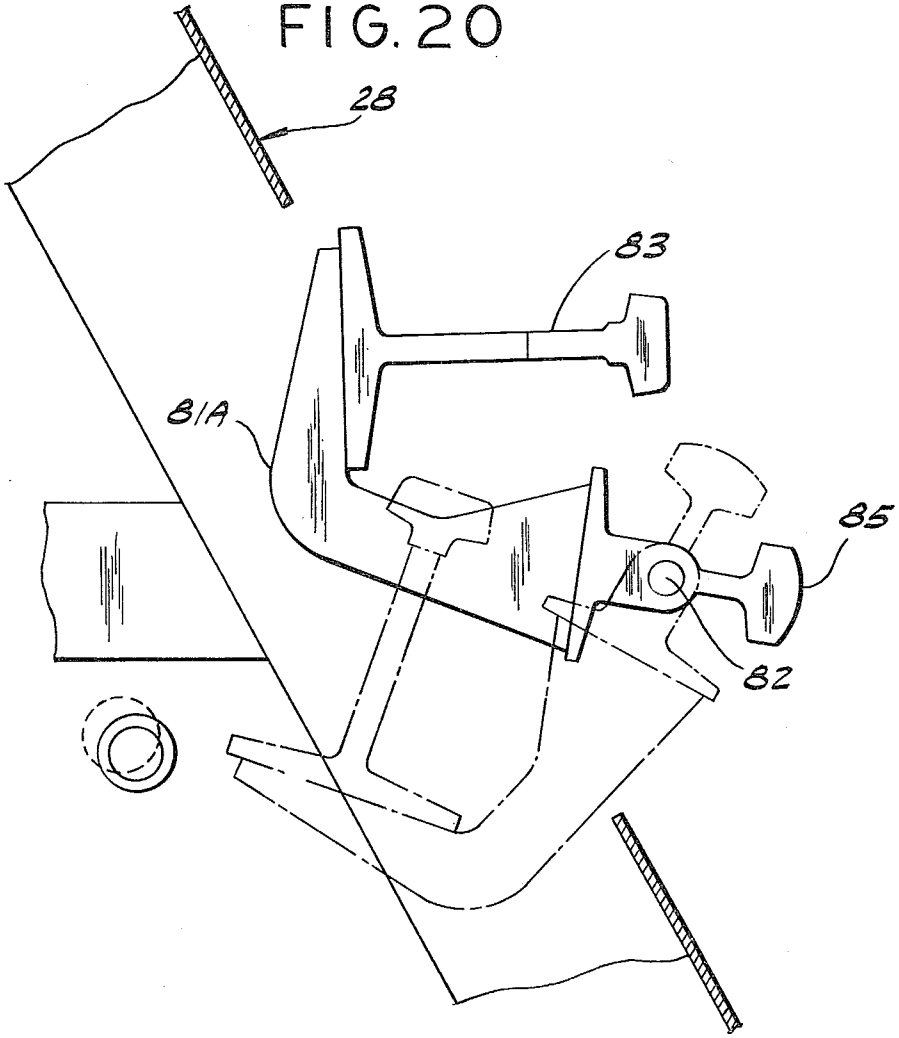
FIG. 20 is an enlarged section on line 20—20 of FIG. 19.
Figure 23:
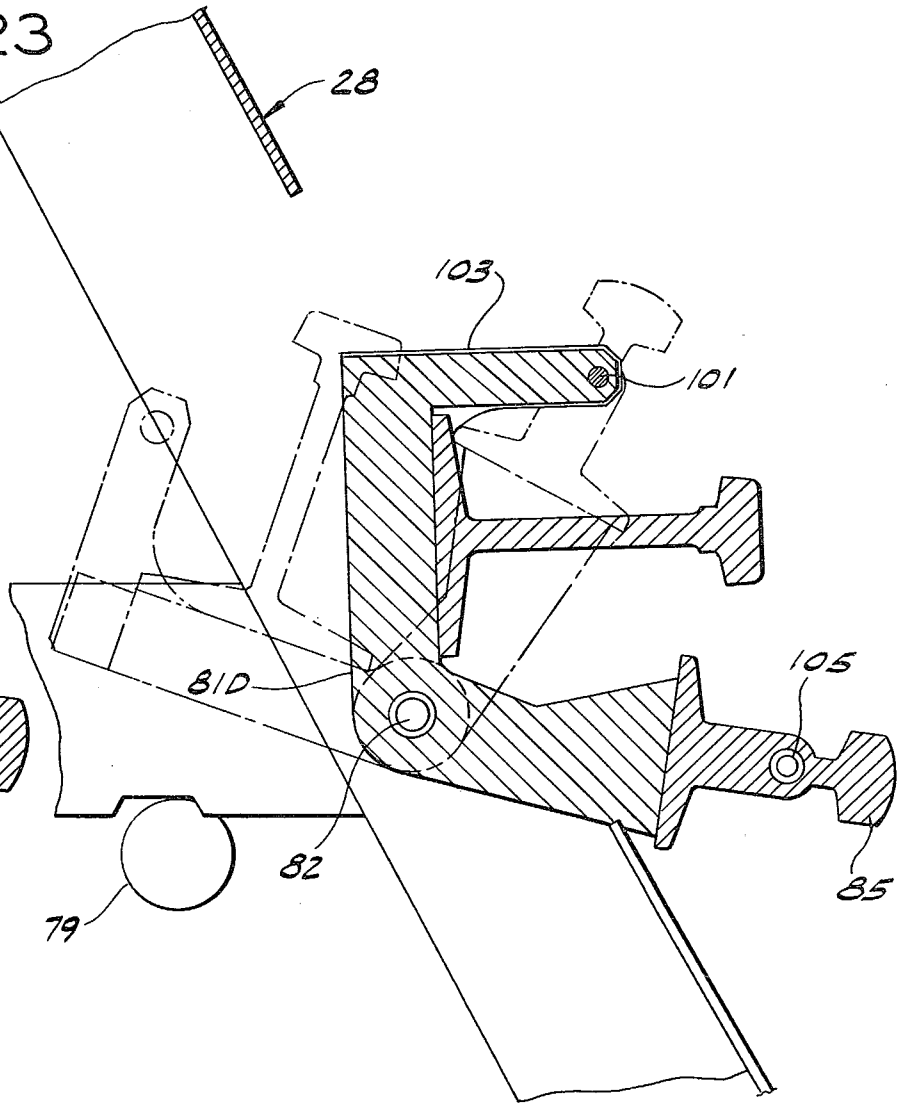
FIG. 23 is an enlarged section on line 23—23 of FIG. 19.
Figure 22:
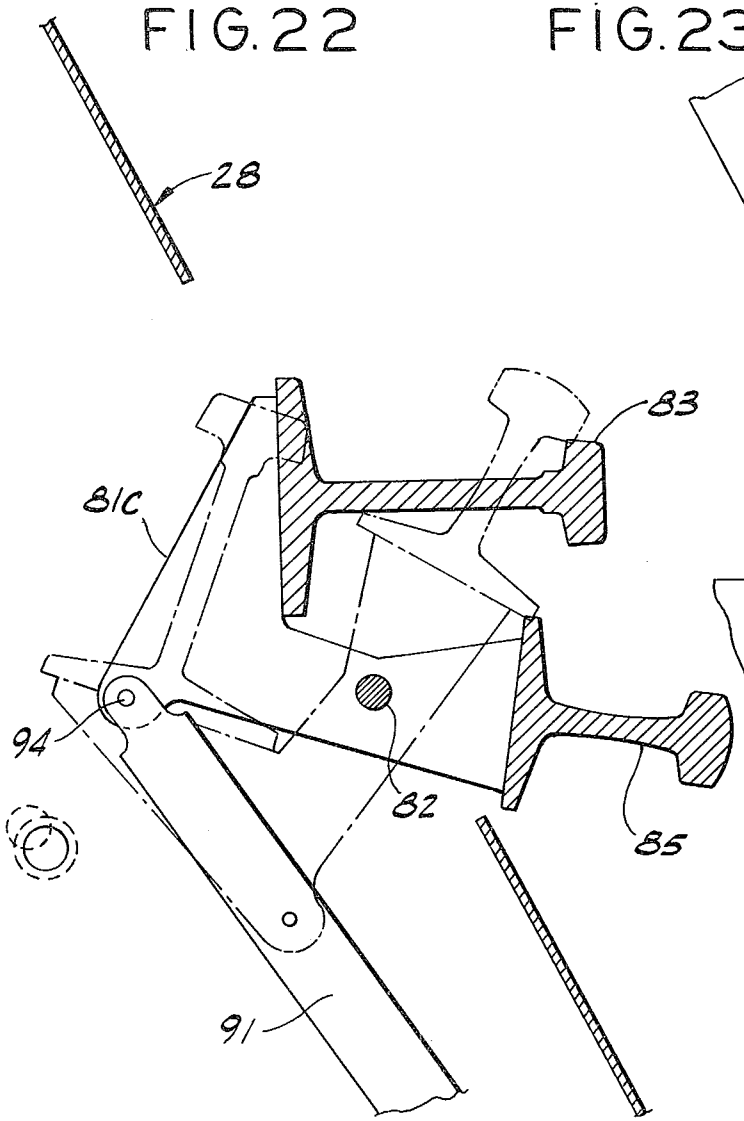
FIG. 22 is an enlarged section on line 22—22 of FIG. 19.

The crossover means 41 comprises a plurality of L-shaped support members (four such members, designated 81A–81D, as illustrated) secured to a rod 82 pivotally mounted at its ends on the truss 28 for enabling pivoting of the crossover means about an axis extending generally longitudinally of the truss between a first angular position (illustrated by the solid lines in FIGS. 20–23) and a second angular position (illustrated by the phantom lines in these figures). A first length of rail 83 is mounted on one leg of each angle member (81A–81D) and forms a part of the upper rail of the lower pair of the fixed switching rails 35 when the crossover means 41 is in its stated first position (see FIG. 19). A second length of rail 85 is mounted on the other leg of each angle member and forms a part of the lower rail of the upper pair of fixed switching rails 33 when the crossover means 41 is in its stated second position.

At 45 is indicated means connecting the support member 81C and the operating rod 79 for pivoting the crossover means 41 in response to reciprocation of the actuator bar 61 thereby to coordinate movement of the crossover means 41 with the movement of the movable switching rails 37. This means 45 comprises a bellcrank 87 mounted on the truss 28 below the pivot bar 81 for pivotal movement about a generally horizontal axis extending transversely of the truss. The upper end of one arm 89 of the crank is pin-connected to the operating rod 79 at 90. A generally vertically extending link 91 is pin-connected at its lower end, as indicated at 92, to the lower arm 93 of the bellcrank, and at its upper end, as indicated at 94 in FIG. 22 to the support member 81C. The arrangement is such that means 45 pivots crossover means 41 toward its stated first angular position as the actuator bar and operating rod are moved to the left toward the common track end of the truss (and thus as the movable switching rails 37 are moved toward their lowered position), and pivots the crossover means toward its stated second angular position as the actuator bar is moved toward the right (and thus as the pair of movable switching rails is raised).

Figure 24:
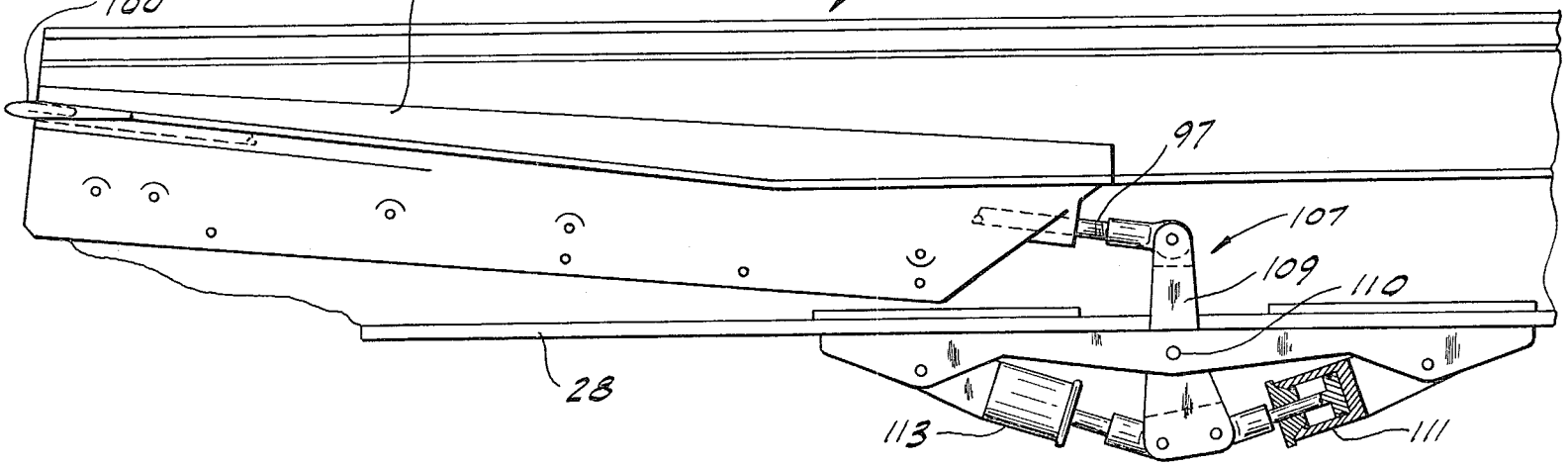
FIG. 24 is an enlarged elevation of locking means for the crossover means.
Figure 4:
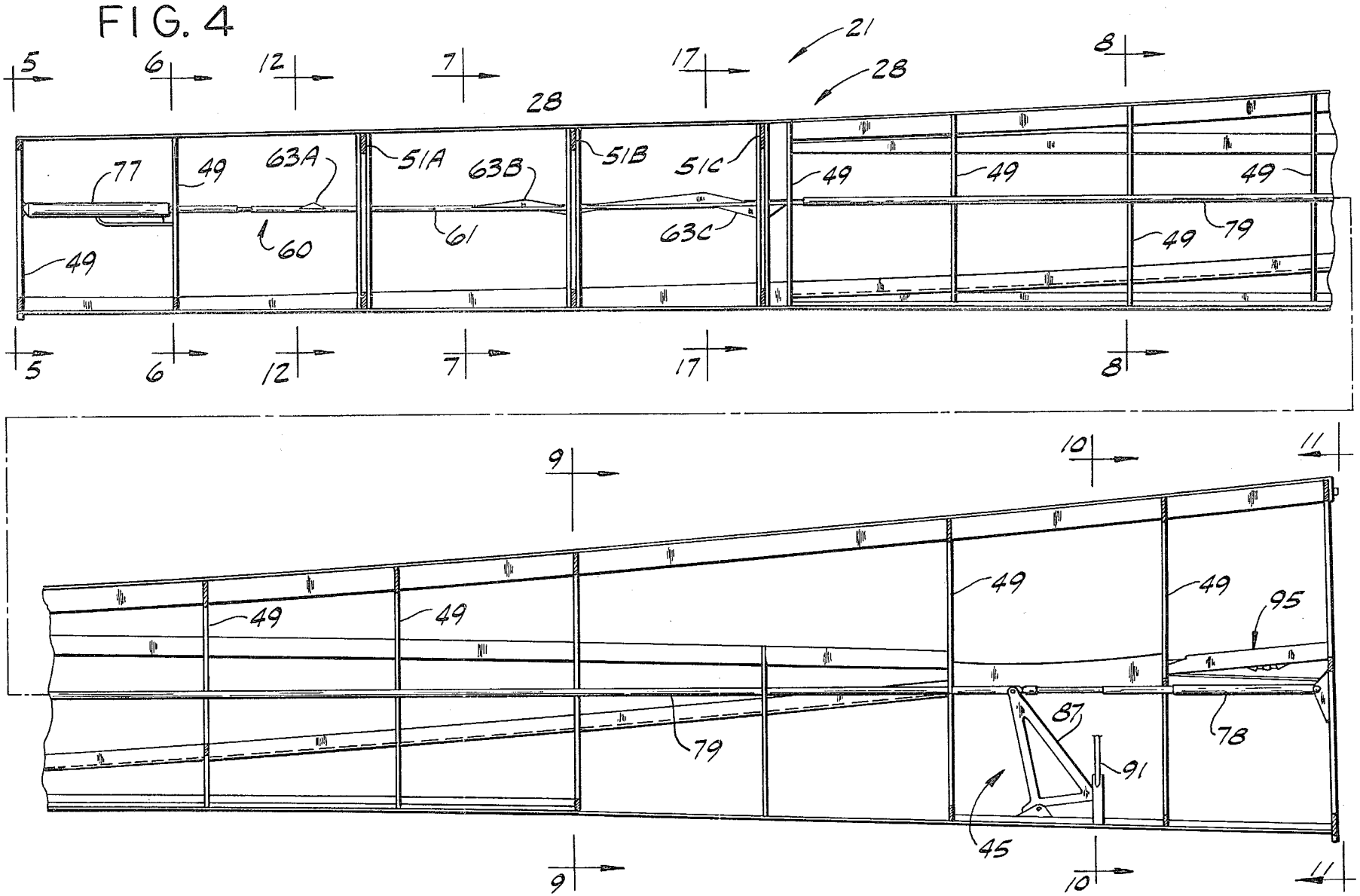
FIG. 4 is a side elevation of the switch assembly with parts removed to show interior detail.

Locking means indicated generally at 95 in FIG. 24 is provided for releasably securing the crossover means 41 in its stated first and second angular positions, thereby preventing unintended pivoting of the crossover means under the weight of a railway car traveling along the first or second rail 83, 85. Moreover, it functions via the connecting means 45, operating rod 79, and actuator bar 61 releasably to secure the pair of movable switching rails 37 in position. The locking means 95 comprises a locking pin 97 guided by a guide member 99 mounted on the truss for reciprocation between an extended position in which the end 100 of the pin is received either in a hole 101 in a lock member 103 on the support member 81D to secure the crossover means 41 in its stated first angular position, or in a hole 105 in the end of the second rail 85 to secure the crossover means in its stated second angular position, and a retracted position in which the pin is clear of the crossover means for enabling it to pivot freely.

An actuator mechanism 107 on the truss 28 moves the locking pin between its extended and retracted positions. It comprises a lever 109 pinned at 110 to the truss for pivoting on an axis extending transversely of the truss. The lever is pinned at its upper end to the locking pin 97 and at its lower end to the piston ends of a pair of opposing hydraulic or pneumatic cylinder units 111, 113, the cylinder ends of which are pin-connected to the truss. Like the cylinder units 77, 78, each cylinder unit 111, 113 is independently controlled by a separate circuit and is capable of developing sufficient force to reciprocate the locking pin under normal conditions without assistance from the other unit. This increases the operational reliability of the locking means and thus the reliability of the switch.

In operation, the switch 29 is switched between its first mode in which it connects the common track 3 and the lower branch track 9 via the lower fixed switching rails 35 and its second mode in which it connects the common track 3 and the upper branch track 15 via the upper fixed switching rails 33, by actuating a cylinder unit 111 or 113 to unlock the crossover means 41, actuating a cylinder unit 77 or 78 to reciprocate the actuator bar 61 for moving the switching rails 37 and pivoting the crossover means 41, and thereafter actuating a cylinder unit 111 or 113 to lock the switching rails 37 and crossover means 41 in position. For example, to switch the switch from its first mode to its second mode, a cylinder unit 111 or 112 is actuated to withdraw the locking pin 97 from the opening 101 in the locking member 103. A cylinder unit 77 or 78 is then actuated to move the actuator bar 61 and operating rod 79 to the right toward the branch track end of the truss for lifting the movable supports 39A–39C and thus the movable switching rails 37 to their raised positions and for pivoting the crossover means 41 to its stated second position. Thereafter a cylinder unit 111 or 113 is actuated to move the locking pin 97 into the hole 105 in the second rail 85 for securing it in position. To switch the switch back to its first mode, these operations are repeated but with a cylinder unit 77 or 78 being actuated so as to move the actuating bar 61 and operating rod 79 to the left toward the common track end of the truss structure.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A switch for a railway system having a common track, a first branch track constituting an upper branch track, and a second branch track constituting a lower branch track, each track comprising a pair of rails with one rail of the pair disposed above the other, said switch comprising fixed support means between said common and branch tracks, a first pair of fixed switching rails, constituting an upper pair of fixed switching rails, on said fixed support means associated with the upper branch track, a second pair of fixed switching rails, constituting a lower pair of fixed switching rails, on said fixed support means associated with the lower branch track, a pair of movable switching rails movable between a raised position in which the pair extends between the common track and the upper pair of fixed switching rails and a lowered position in which the pair extends between the common track and the lower pair of fixed switching rails, a plurality of movable supports carrying the movable switching rails mounted on the fixed support means at spaced intervals therealong, each movable support being guided for movement transversely with respect to the direction of length of the movable switching rails and generally in the plane of these rails, and means engageable with said movable supports for moving each support through a predetermined range of movement with respect to the fixed support means transversely with respect to the direction of length of the movable switching rails and generally in the plane of said movable switching rails, the range of movement of the movable supports progressively increasing from the movable support adjacent the common track to the movable support adjacent the branch tracks, said means for moving the movable supports comprising an elongate actuator bar mounted on the fixed support means for reciprocation along its axis longitudinally of the fixed support means, said actuator bar having cam means thereon at spaced intervals corresponding to the spaced intervals of the movable supports, said cam means being engageable with the movable supports on reciprocation of the bar for moving the supports through said predetermined range of movement, said cam means comprising a pair of cams associated with each movable support projecting from the actuator bar on opposite sides of the bar in a plane parallel to the plane of the movable switching rails, the cams of each pair being offset with respect to one another longitudinally of the bar, one cam of the pair having a camming surface engageable with a respective movable support on movement of the bar in one direction for moving the support to one extreme of its range of movement, and the other cam of the pair having a camming surface engageable with the support on movement of the bar in the opposite direction for moving the support to the opposite extreme of its range of movement.

2. A switch as set forth in claim 1 wherein the maximum distance which the camming surface of each cam of said pair of cams projects from the actuator bar progressively increases from the pair of cams adjacent the common track to the pair adjacent the branch tracks for progressively increasing said range of movement of the movable supports.

3. A switch as set forth in claim 2 wherein each movable support has a hole therein slidably receiving the actuator bar therethrough, said hole being so sized and configured that opposing edges thereof are engageable by the camming surfaces of the pair of cams associated with the movable support.

4. A switch as set forth in claim 3 further comprising pairs of guide plates rigidly mounted on the fixed support at spaced intervals therealong corresponding to the spaced intervals of the movable supports, each movable support being slidable between a respective pair of guide plates generally in the plane of the movable switching rails, said guide plates having holes therein for slidably receiving said actuator bar therethrough.

5. A switch as set forth in claim 1 further comprising rail crossover means mounted on the fixed support means at the intersection of the line of the lower rail of the upper pair of fixed switching rails with the line of the upper rail of the lower pair of fixed switching rails, and means connecting the crossover means and the actuator bar for moving the crossover means in response to movement of the actuator bar between a first position in which it is aligned with and forms a part of the upper rail of the lower pair of fixed switching rails when the pair of movable rails is in its lowered position, and a second position in which it is aligned with and forms a connection in the lower rail of the upper pair of fixed switching rails when the pair of movable rails is in its raised position.

6. A switch as set forth in claim 5 wherein the crossover means comprises first and second lengths of rail pivotable about an axis extending generally longitudinally of the fixed support means, the first length of rail being adapted to extend in the line of the upper rail of the lower pair of fixed switching rails when said crossover means is in said first position, and the second length of rail being adapted to extend in the line of the lower rail of the upper pair of fixed switching rails when said crossover means is in said second position.

7. A switch as set forth in claim 6 wherein said connecting means comprises a bell crank mounted on the fixed support means for pivoting on an axis extending generally transversely with respect to the fixed support means, said crank having a first arm connected to the actuator bar and a second arm to the crossover means, said bell crank being adapted to pivot on its axis on reciprocation of the actuator arm for pivoting said crossover means between its said first and second positions.

8. A switch as set forth in claim 6 further comprising locking means for releasably securing the crossover means in either of its said positions.

* * * * *